United States Patent [19]

Hudson, Sr.

[11] Patent Number: 4,936,578

[45] Date of Patent: Jun. 26, 1990

[54] QUARTERBACK PRACTICE TARGET

[76] Inventor: James Hudson, Sr., 14815 S. Normandie #14, Gardena, Calif. 90247

[21] Appl. No.: 471,401

[22] Filed: Jan. 29, 1990

[51] Int. Cl.[5] ..... A63B 63/04

[52] U.S. Cl. ..... 273/55 R; 273/402

[58] Field of Search ..... 273/55 R, 402

[56] References Cited

U.S. PATENT DOCUMENTS

| | | | |
|---|---|---|---|
| 1,258,931 | 3/1918 | Newcombe | 273/402 |
| 2,008,359 | 7/1935 | Lamb | 273/402 |
| 3,602,504 | 8/1971 | Chapman | 273/55 R X |
| 3,703,289 | 11/1972 | Hohman | 273/55 R |
| 3,823,939 | 7/1974 | Bottorff | 273/55 R |
| 4,079,939 | 3/1978 | Raistakka | 273/402 |
| 4,092,023 | 5/1978 | Hazen | 273/55 R X |

*Primary Examiner*—William H. Grieb

*Attorney, Agent, or Firm*—Donald J. Breh

[57] ABSTRACT

A sport's training aid for a quarterback including an extensible-retractable vertical pole having a horizontal arm and pass throwing target loops located at lower and upper positions on the vertical pole and at the free ends of the horizontal arm. The target loops are located at positions representing pass reception locations of different common types of passes thrown by a quarterback.

20 Claims, 2 Drawing Sheets

QUARTERBACK PRACTICE TARGET

BACKGROUND OF THE INVENTION

This invention relates to a sports training device. More particularly, the invention relates to a device for improving the passing accuracy of a football quarterback.

Training devices for improving the accuracy of ball throwing including that of passing a football exist and typically include devices having rings, hoops, baskets or nets through or into which the ball is thrown. Typical devices suitable for improving the accuracy of football passing are disclosed in U.S. Pat. Nos. 3,703,289; 3,823,939 and 4,092,023. The device of U.S. Pat. No. 4,092,023 is simply a single ring which rises or lowers to different heigths. The device in U.S. Pat. No. 3,703,289 is somewhat more versatile in that it adds a second ring as well as a revolving feature adding a timing element to the user's training. The apparatus of U.S. Pat. No. 3,823,939 is somewhat more sophisticated in that it uses a linearly moving basket adding a degree of direction skill to the user's training.

While effective, these known devices all have certain limitations and shortcomings including principally the fact that they do not necessarily provide for passing a football into different common or typical passing areas. For example all of these known devices provide for practicing passing only into one area or height above the ground without having to readjust the device. Further, except for the device of U.S. Pat. No. 4,092,023, these devices do not provide for varying the heigths or distance of the pass reception area above the ground. The user of these devices either can practice only one type of pass which does not necessarily represent a common or typical pass type or must readjust the apparatus in order to practice throwing a different type of pass. For example, typical pass types include high or overhead passes, right or left passes or buttonhook type passes which are thrown generally low to the ground. No pass training aid device is known which singularly provides for practicing all of these common pass types and it is the object of this invention to provide for such a training aid.

SUMMARY OF THE INVENTION

According to the invention, there is provided a practice target adapted to increase the accuracy of a quarterback's passing including a base having an extensible-retractable vertical pole, a horizontal arm mounted to the vertical pole intermediate its length and a plurality of target loops positioned on the vertical pole and horizontal arm at predetermined common pass reception areas.

According the invention, there is at least one target loop on the vertical pole and at least one target loop on the horizontal arm.

According to a preferred embodiment, the horizontal arm includes a third target loop and the vertical pole includes a fourth target loop.

According to an important feature of the invention, one of the two target loops on the vertical pole is located at a fixed lower position on the vertical pole representing a buttonhook-type pass reception location and the other target loop is located at an upper free end of the extensible- retractable portion of the vertical pole representing an overhead-type pass reception location.

According to another feature of the invention, the two target loops on the horizontal arm are located at opposite free ends of the horizontal arm.

According to a still further important feature of the invention, the upper target loop and two target loops on the horizontal arm are rotatable to selected angular positions in different vertical planes.

Yet another feature of the invention provides for the horizontal arm to be rotatable about the vertical pole.

A still further important feature of the invention provides for the target loops on the horizontal arm to be mounted on vertical arms extending in opposite vertical directions above and below the horizontal arm.

Another advantageous feature provides for the oppositely directed vertical arms to be mounted to the horizontal for positioning and retention at positions either vertically above or vertically below the horizontal arm.

According to a preferred embodiment, the vertical pole is a two part pole having a tubular lower portion carrying the lower target loop and a cylindrical upper portion slidably and rotatably received in the tubular lower portion and carrying the upper target loop.

BRIEF DESCRIPTION OF THE DRAWINGS

The invention will be better understood after reading the following Detailed Description of the Preferred Embodiment in conjunction with the drawings in which.

DETAILED DESCRIPTION OF THE PREFERRED EMBODIMENT

Figure 1:
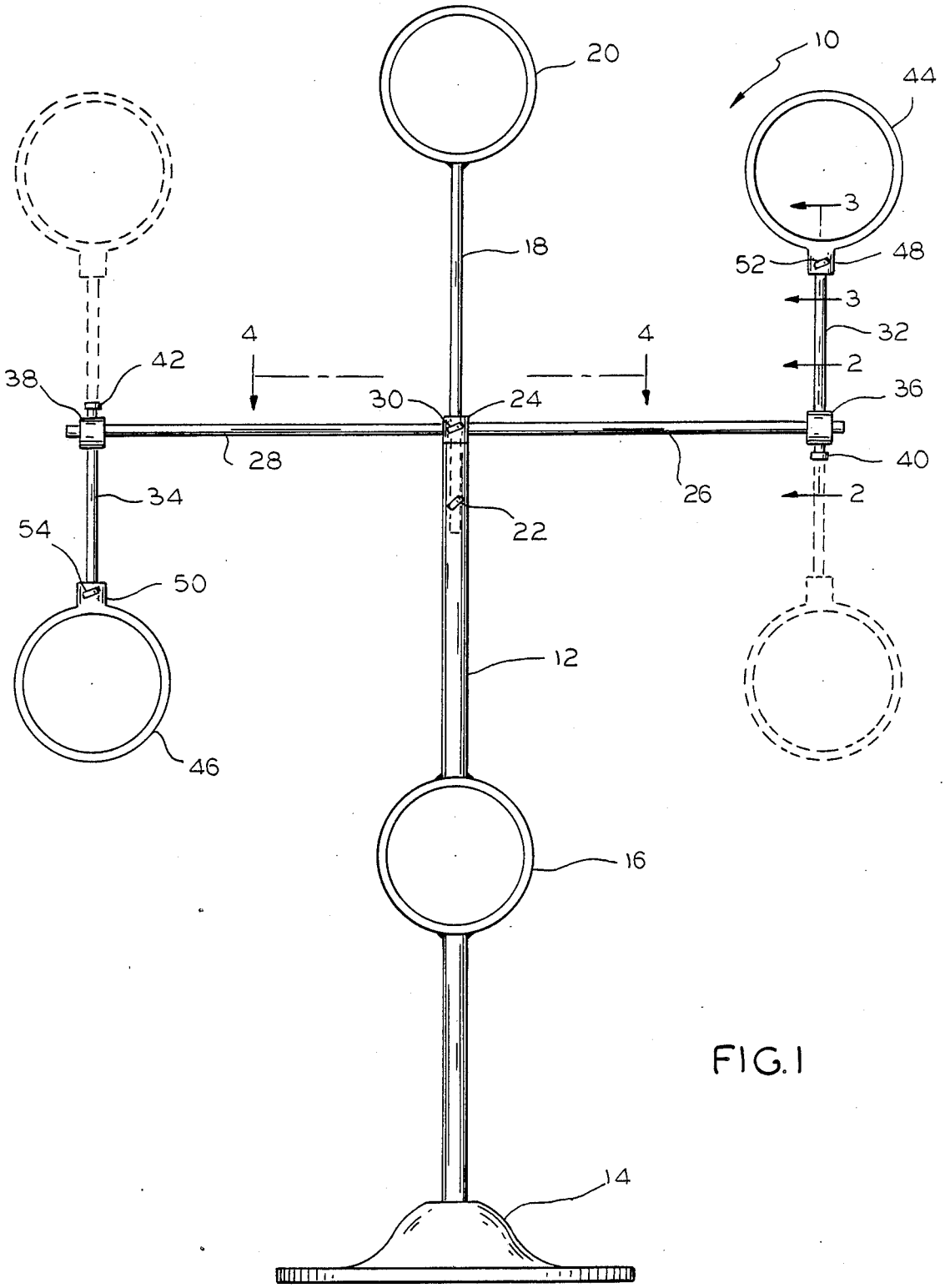
FIG. 1 which is a pictorial view of a preferred embodiment of a practice target according to the invention showing details of construction.
Figure 5:
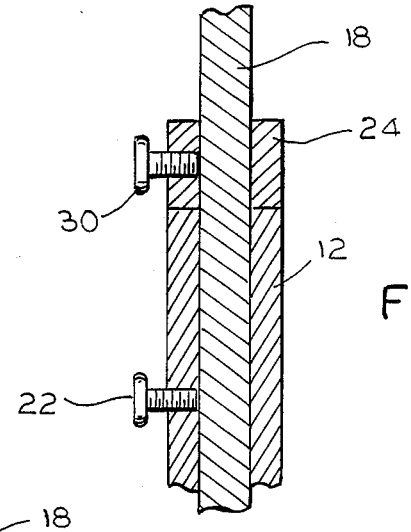
FIG. 5 is a cross sectional view taken along the line 5—5 in FIG. 4 showing details of construction of the vertical pole.
Figure 6:
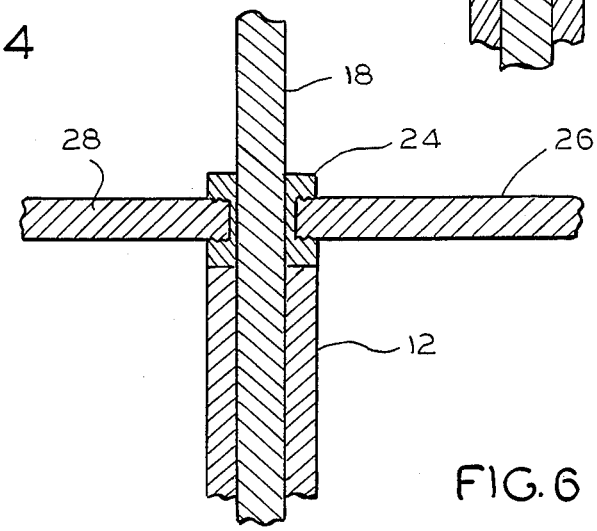
FIG. 6 is a cross sectional view taken along the line 6—6 in FIG. 4 showing further details of construction of the vertical pole and horizontal arm mounting arrangement.

Shown in FIG. 1 is a practice target 10 especially adapted as a training aid for improving the passing accuracy of football quarterback. The target 10 includes a heavy or weight base 14 having a vertical pole including a tubular lower portion 12 and an extensible-retractable cylindrical upper portion 18 that is slidably received in the tubular portion 12. As shown in FIGS. 1 and 5, a set screw, for example a thumb screw, or other user operated retention member 22 is provided in the sidewall of the tubular member 12 to engage and hold the upper portion 18 in selected vertical positions.

The vertical pole is provided with at least one and preferrably two target loops 16, 20. A lower target loop 16 is welded or otherwise affixed to the lower pole portion 12 at a location off the ground upon which the base 14 rests representative of a pass reception location commonly known as a buttonhook-type pass. Typically, a buttonhook-type pass is a pass thrown by a quarterback at a receiver at a location generally low to the ground. Although not limited to any specific distance from the ground, the lower target loop 16 might be located for example at about 2 to 3 feet off the ground.

As shown in FIGS. 1 and 4–6, a horizontal arm including a right arm portion 26 and a left arm portion 28 is mounted to the vertical pole by way of a collar 24 which is slidably and rotatably received on the upper extensible-retractable pole portion 18. As noted below, the upper extensible-retractable pole portion 18 is slidable within the collar 24 upon loosening a set screw 30 providing for vertical positioning of the upper target loop 20 independantly of the horizontal arm.

Affixed to the upper end of the extensible-retractable portion of the vertical pole is an upper target loop 20 representative of a high overhead-type pass reception location. Obviously the height of the upper target loop 20 can be varied by loosening the set screw 22 and extending or retracting the pole portion 18 to position the target loop 20 as desired. It is contemplated that the vertical pole would adjust to an upper limit of for example about 7 feet off the ground. Of course, provision for extending the pole higher can be provided for if desired.

Figure 2:
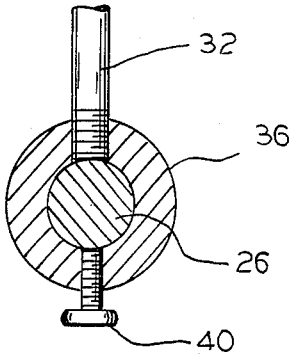
FIG. 2 is a cross sectional view taken along the line 2—2 in FIG. 1 showing details of construction of a mounting collar for mounting the target loop vertical arms to the horizontal arm.
Figure 3:
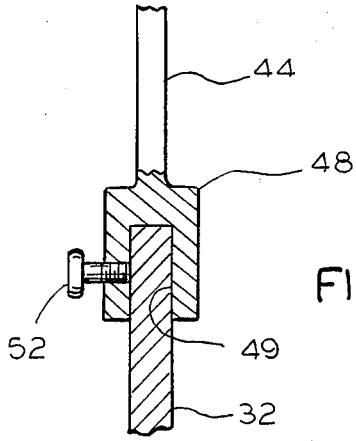
FIG. 3 is a cross sectional view taken along the line 3—3 in FIG. 1 showing details of construction of the mounting of the side target loops to the vertical arms.
Figure 4:
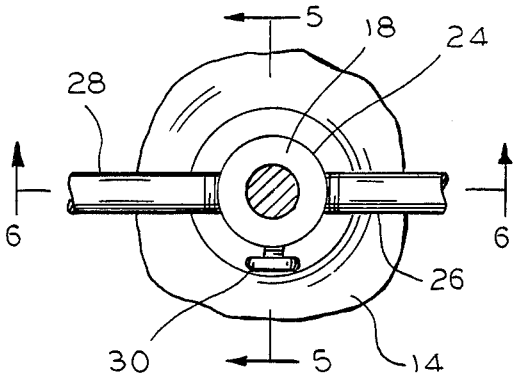
FIG. 4 is a cross sectional view taken along the line 4—4 in FIG. 1 showing details of construction of the mounting of the horizontal target arm to the device.

As shown, the free ends of the horizontal arm carry additional side target loops 44, 46 positionable at typical right and left side pass reception locations relative to the buttonhook and overhead pass target loops and are positioned at intermediate distances from the ground of for example about from 3 to 6 feet. As shown, preferrably, one side target loop, for example target loop 44 in FIG. 1, is located vertically above the horizontal arm at an upper intermediate level and the other side target loop, for example target loop 46 in FIG. 1, is located vertically below the horizontal arm at a lower intermediate level. To achieve this, there is provided a pair of short vertical arms 32, 34 connecting the side target loops 44, 46 to the horizontal arm portions 26, 28 respectively. Although the vertical arms 32, 34 can be upturned and depending portions of the horizontal arm portions 26, 28, it is preferred that a rotatable mounting such as collars 36,38 having set screws 40, 42 as shown in FIGS. 1 and 2 be provided so that the side target loops can be selectively rotated in vertical planes about the horizontal arm and retained at positions either above or below the horizontal arm, as shown in dashed outline in FIG. 1. Also as shown in FIG. 1 and FIG. 3, the side target loops are preferrably provided with bosses 48, 50 each having a blind hole 49 into which the respective vertical arms 32, 34 are received and retained by set screws 52, 54. It can be seen that the side target loops 44, 46 can thus be rotated and angularly positioned in different vertical planes by loosening the set screws 52, 54 and turning the target loops. It is to be further noted that the upper overhead pass target loop 20 can also be angularly positioned in different vertical planes by loosening the set screw 22 and rotating the upper pole portion 18. Angular positioning of the target loops may be desirable either to reduce the target area available, thus making the target more difficult to hit, thereby requiring greater skill and accuracy on the part of the user or, should the user desire to practice throwing passes from a location displaced from on center that is, for example, to simulate a roll out-type pass as opposed to a straight drop back type pass situation. Many variations of use are available owing to the unlimited number of combinations of angular positions and relative vertical positions of the side and overhead targets to which the target loops may be selectively positioned.

It is contemplated that a practice target might have, as noted above, a maximum upper target loop location of about 7 feet off the ground with a lower target loop location of about 2 to 3 feet off the ground. The horizontal arm is contemplated to be about 5 feet off the ground with the side target loops located at from 3 to 6 feet off the ground. The horizontal spacing between the two side target loops can of course vary but a spacing of about 6 feet is contemplated to be adequate. These dimensions are representative only and are believed to adequately represent common typical or nominal pass reception areas relative to the ground and to each other so as to provide reasonable simulation of actual pass reception areas experienced by a quarterback. The target loops might have diameters of about 15 inches but of course can be larger or smaller as desired to either increase or decrease the level of skill required. It is also contemplated that a plurality of different diameter side target loops could be provided which could be easily installed as desired depending on the degree of skill and challange desired.

Having the described the preferred embodiment of the invention, those skilled in the art, having the benefit of the description and the accompanying drawings can readily devise other embodiments and modifications and such other embodiments and modifications are to be considered to be within the scope of the appended claims.

What is claimed is:

1. A practice target for improving the accuracy of a quarterback's pass throwing comprising:

a base;

a vertical pole extending from said base, said vertical pole having at least one target loop located at one of a plurality of predetermined pass reception locations each of said pass reception locations representing a different type of pass commonly thrown by said quarterback;

a horizontal arm affixed to said vertical pole, said horizontal arm having at least a second target loop located at a second of said plurality of predetermined pass reception locations.

2. The practice target as defined in claim 1 further including a third target loop on said horizontal arm, said third target loop located at a third of said plurality of predetermined pass reception locations.

3. The practice target as defined in claim 2 further including a fourth target loop, said fourth target loop being on said vertical pole at a location representing a fourth of said plurality of predetermined pass reception locations.

4. The practice target as defined in claim 3 wherein said fourth target loop is located proximate a free end of said vertical pole and said vertical pole is extensible-retractable.

5. The practice target as defined in claim 4 wherein said at least one target loop, said at least second target loop, said third target loop and said fourth target loop each lie in a common vertical plane.

6. The practice target as defined in claim 4 wherein each of said at least second target loop, said third target loop and said fourth target loop have a vertical axis and each are individually angularly positionable about their respective vertical axis.

7. The practice target as defined in claim 6 wherein said horizontal arm is rotatable about said vertical pole in a horizontal plane and said at least second target loop and said third target loop are mounted at opposite free ends of said horizontal arm.

8. The practice target as defined in claim 7 further including two vertical arms, one extending from each of said opposite ends of said horizontal arm, said at least second target loop and said third target loop mounted respectively to one of said two vertical arms.

9. The practice device as defined in claim 8 wherein one of said vertical arms extends upwardly from said horizontal arm and the second of said two vertical arms extends downwardly from said horizontal arm.

10. The practice device as defined in claim 8 wherein each of said two vertical arms includes means for mounting said vertical arms to said horizontal arm for rotation about said horizontal arm in a vertical plane said means for mounting including means for retaining each of said vertical arms in at least a position disposed vertically upward from said horizontal arm and in a position extending vertically downward from said horizontal arm.

11. A practice target for improving the accuracy of a quarterback's pass throwing comprising:

a base;

an extensible-retractable vertical pole extending from said base including a fixed lower target loop intermediate a base end of said vertical pole and an upper free end of said vertical pole, an upper target loop being at said free end of said vertical pole; and a horizontal arm mounted to and crossing said vertical pole at a location intermediate said lower target loop and said upper target loop, said horizontal arm including a right side target loop at one end of said horizontal arm and a left side target loop at a second end of said horizontal arm.

12. The practice target as defined in claim 11 wherein said upper target loop, said right side target loop and said left side target loop are each mounted for angular positioning in different vertical planes.

13. The practice target as defined in claim 12 wherein said right side target loop and said left side target loop are respectively mounted at free ends of one of two arms extending from the one end and the second end of said horizontal arm in at least vertically opposite directions.

14. The practice target as defined in claim 12 wherein said horizontal arm is mounted to said vertical pole for rotation about said vertical pole in a horizontal plane to different angular positions.

15. The practice target as defined in claim 13 wherein each of said two arms are mounted to said horizontal arm for selective positioning at at least a position located vertically above said horizontal arm and a position located vertically below said horizontal arm.

16. The practice target as defined in claim 13 including a collar rotatably mounted on said vertical pole, said horizontal arm including a right arm portion extending from said collar and a left arm portion extending from said collar, said collar including means for releaseable retaining said collar to said vertical pole.

17. A practice target for improving the accuracy of a quarterback's pass throwing comprising:

a base;

a vertical pole including a lower stationary portion extending from said base, an upper extensible-retractable portion and means for retaining said upper extensible-retractable portion in selected vertical positions;

a horizontal arm including means for mounting said horizontal arm to said upper extensible-retractable portion of said vertical pole, said means for mounting providing for rotation of said horizontal arm about said vertical pole in a horizontal plane and further providing for retention of said horizontal arm in selected angular positions, said means for mounting further providing for extension and retraction of said upper portion of said vertical pole independantly of said horizontal arm and for positioning and retaining of said horizontal arm along said upper portion of said vertical pole at different selected vertical positions;

a fixed lower target loop mounted to said stationary portion of said vertical pole below said horizontal arm;

an upper target loop mounted at a free end of said upper extensible-retractable portion of said vertical pole; and a pair of side target loops one mounted to each of opposite free ends of said horizontal arm.

18. The practice target as defined in claim 17 wherein said lower stationary portion of said vertical pole is tubular, said upper extensible-retractable portion of said vertical pole is slidably received in said tubular portion, and said means for retaining said upper extensible-retractable portion in selected vertical positions includes a first set screw in said tubular portion contacting said upper extensible-retractable portion and said means for mounting said horizontal arm to said upper extensible-retractable portion includes a collar slidably received on said upper extensible-retractable portion and a second set screw in said collar contacting said upper extensible-retractable portion, said horizontal arm including a first arm portion and a second arm portion extending in opposite directions from said collar.

19. The practice target as defined in claim 17 wherein said side target loops at the opposite free ends of said horizontal arm each include means providing for rotation and retention of said side target loops to selected angular positions in different vertical planes.

20. The practice target as defined in claim 18 wherein each of said side target loops are respectively mounted on one of a pair of vertical arms extending in opposite directions from the free ends of said horizontal arm.

* * * * *